US011338988B2

(12) United States Patent
Yan

(10) Patent No.: US 11,338,988 B2
(45) Date of Patent: May 24, 2022

(54) DISPENSING PUMP AND MANUFACTURING METHOD THEREOF

(71) Applicant: ID PACKAGING Inc., Kirkland (CA)

(72) Inventor: Jian Yan, Kirkland (CA)

( * ) Notice: Subject to any disclaimer, the term of this patent is extended or adjusted under 35 U.S.C. 154(b) by 0 days.

(21) Appl. No.: 17/045,434

(22) PCT Filed: Apr. 5, 2019

(86) PCT No.: PCT/IB2019/052825
§ 371 (c)(1),
(2) Date: Oct. 5, 2020

(87) PCT Pub. No.: WO2019/193568
PCT Pub. Date: Oct. 10, 2019

(65) Prior Publication Data

US 2021/0163213 A1 Jun. 3, 2021

Related U.S. Application Data

(60) Provisional application No. 62/653,626, filed on Apr. 6, 2018.

(51) Int. Cl.
*B65D 83/00* (2006.01)
*B05B 11/00* (2006.01)

(52) U.S. Cl.
CPC ..... *B65D 83/0055* (2013.01); *B65D 83/0005* (2013.01); *B05B 11/3001* (2013.01)

(58) Field of Classification Search
CPC ..... B65D 83/0055; B65D 83/0005; B05B 11/3001; B05B 11/3087; B05B 11/3088; B05B 11/309
USPC ..... 222/105, 144, 144.5, 145.1, 402.17, 222/402.19, 321.6, 321.8, 287–289, 222/153.13, 153.14
See application file for complete search history.

(56) References Cited

U.S. PATENT DOCUMENTS 2,815,890 A 12/1957 Cooprider et al.
3,348,740 A 10/1967 O'Donnell
4,846,372 A 7/1989 von Schuckmann
(Continued)

FOREIGN PATENT DOCUMENTS

BE 882053 A 7/1980
CN 2314128 Y 4/1999
(Continued)

OTHER PUBLICATIONS

International patent application No. PCT/IB2019/052825 International Search Report dated Aug. 20, 2019.
(Continued)

*Primary Examiner* — Lien M Ngo
(74) *Attorney, Agent, or Firm* — Anglehart et al.

(57) ABSTRACT

A dispensing pump mechanism is provided. The pump comprises integrally molded temper-evidence part between a container collar and a spout; said collar has multiple off-centre outlet channel for dispensing one or more products from the container; said collar also comprises an integrated air vent to be blocked and opened by the rotation of the spout. The whole pump can be over-molded one-piece structure with elastic parts as being actuating parts. The pump improves the functions of the pump, such as lower restitution rate, less structural parts, lower cost, water/dust proof, lightweight, easy assembly.

10 Claims, 10 Drawing Sheets

(56) References Cited

U.S. PATENT DOCUMENTS

| | | | | |
|---|---|---|---|---|
| 4,979,646 | A | 12/1990 | Andris | |
| 5,152,431 | A * | 10/1992 | Gardner | B05B 11/3081 222/136 |
| 5,370,275 | A * | 12/1994 | Mills | B05B 11/3081 222/136 |
| 5,398,846 | A | 3/1995 | Corba et al. | |
| 5,433,350 | A * | 7/1995 | Graubart | B05B 11/3011 222/136 |
| 5,497,915 | A | 6/1996 | Wass | |
| 6,357,629 | B1 | 3/2002 | Ding | |
| 6,659,311 | B2 * | 12/2003 | Prueter | B05B 11/3081 222/136 |
| 6,769,573 | B1 * | 8/2004 | Kazarian | B05B 11/3081 222/136 |
| 7,594,594 | B2 | 9/2009 | Troost et al. | |
| 7,793,866 | B2 * | 9/2010 | Chou | B05B 11/0029 239/354 |
| 10,807,113 | B2 * | 10/2020 | Santagiuliana | B05B 11/0044 |
| 2007/0023452 | A1 | 2/2007 | Tseng | |
| 2008/0029550 | A1 | 2/2008 | Marelli | |
| 2009/0302064 | A1 * | 12/2009 | Lavabre | B05B 11/00442 222/207 |
| 2010/0230443 | A1 | 9/2010 | Ding | |
| 2012/0031925 | A1 * | 2/2012 | Greenberg | B65D 83/68 222/135 |
| 2013/0075428 | A1 * | 3/2013 | Brugger | B05B 11/3083 222/136 |
| 2013/0269830 | A1 | 10/2013 | Farrar et al. | |
| 2014/0217120 | A1 * | 8/2014 | Berry | B05B 11/3081 222/136 |
| 2016/0167075 | A1 | 6/2016 | Mizushima et al. | |
| 2017/0291184 | A1 | 10/2017 | Tada | |

FOREIGN PATENT DOCUMENTS

| | | | |
|---|---|---|---|
| CN | 1750883 | A | 3/2006 |
| CN | 1812846 | A | 8/2006 |
| CN | 1948094 | A | 4/2007 |
| CN | 101391686 | A | 3/2009 |
| DE | 20116698 | U1 | 4/2002 |
| EP | 2058241 | A1 | 5/2009 |
| GB | 2518854 | A | 4/2015 |
| WO | 2004/080607 | A1 | 9/2004 |
| WO | 2010/131042 | A1 | 11/2010 |
| WO | 2015/135689 | A1 | 9/2015 |

OTHER PUBLICATIONS

International patent application No. PCT/IB2019/052825 Written Opinion of the International Searching Authority dated Aug. 20, 2019.

Canadian patent application No. 3,071,353 Office Action dated Apr. 30, 2020.

Canadian patent application No. 3,071,353 Decision to grant the patent dated Oct. 21, 2020.

Related European patent application No. 19780839.7 partial supplementary European search report dated Nov. 30, 2021.

Related European patent application No. 19780839.7 Extended European search report dated Mar. 14, 2022.

* cited by examiner 100
101
102
103
105

103

101
102
101
102
104

Rotate 90°
Rotate 90°
Rotate 90°
A
A
B
B
C
C
212

Close 1
Open1
Close 2
Open 2

210

220

222
221
216
214

SECTION A-A
225
213
211
212

SECTION B-B
215
221
223
213
215

SECTION C-C
223

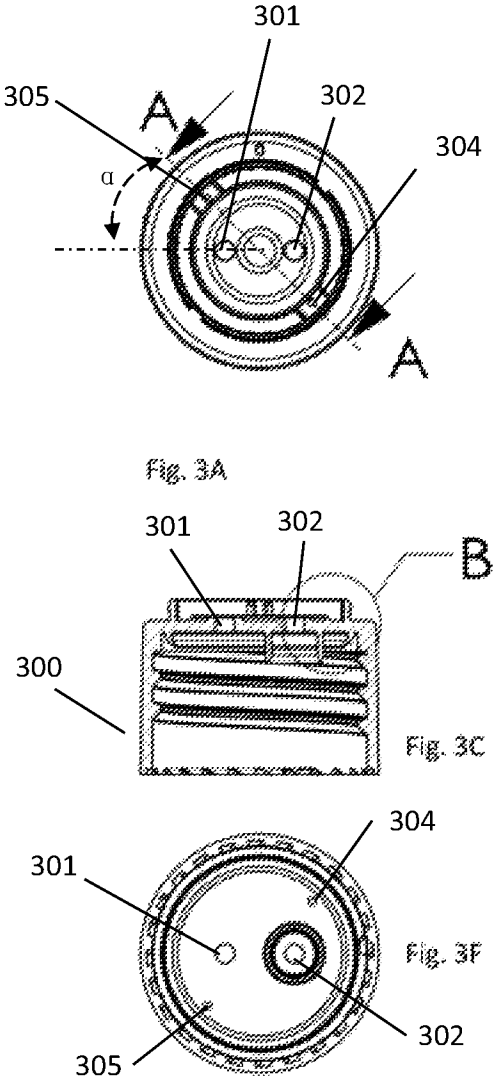
Fig. 3A
Fig. 3B
Fig. 3C
Fig. 3F
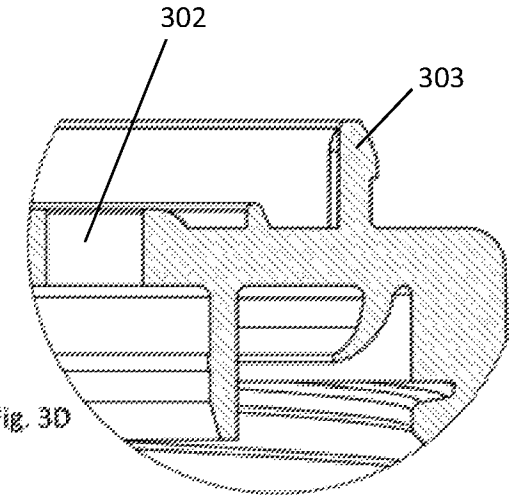
Fig. 3D
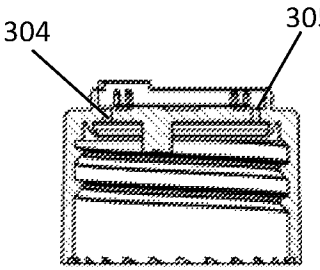
SECTION A-A
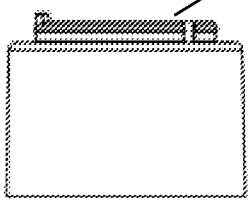
Fig. 3E
DETAIL B
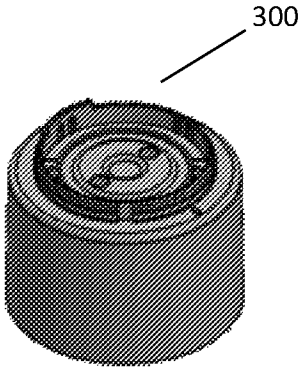
Fig. 3G 400
ID pump

412

410
413
415
411
412

ID pump 413
423
421
426
412

A
A
425

423
422
421
425
420
424

SECTION A-A

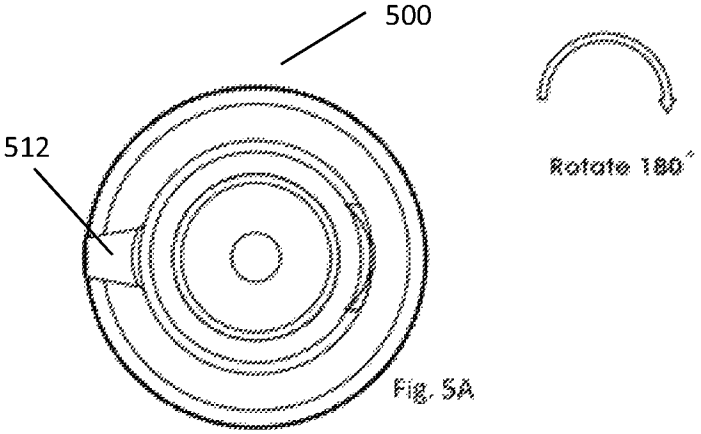
Fig. 5A
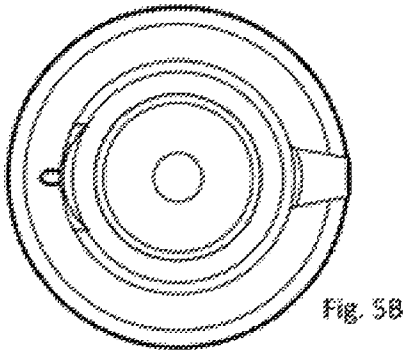
Fig. 5B
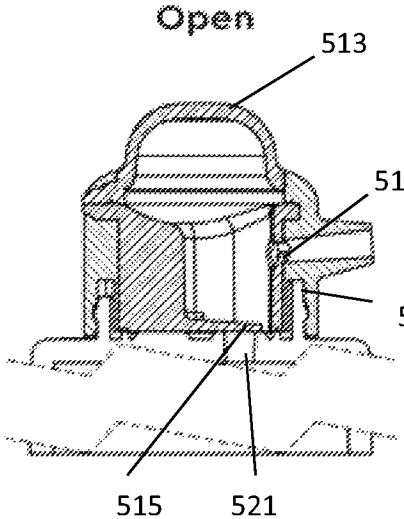
Fig. 5C
Fig. 5D
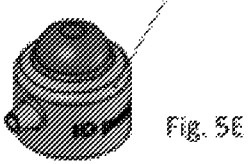
Fig. 5E
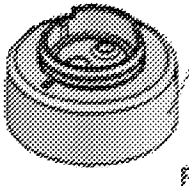
Fig. 5F A
A
Rotate 90°
α
B
B
712
Rotate 90°
α
C
C
Rotate 90°
Close 1
Open1
Close 2
Open 2

705
711
D
704
C
710
730
723b
723
723a
720
SECTION A-A
SECTION B-B
SECTION C-C

DETAIL D 717
714
723
704
701

840
830
821
820
Rotate 180°
ID pump
810
811

850

ID pump
800

ID pump
830
Rotate 180°

910
911

924
923
920
922
921

DETAIL B
9243a
9243b

SECTION C-C
9242
9241

B

C
C
A
A

900

SECTION A-A 1010
1013
1011

1023
1022
1020
1024

1012

1021
1026
1024

ID pump

A
A

ID pump

ID

SECTION A-A

DISPENSING PUMP AND MANUFACTURING METHOD THEREOF

This application claims priority from U.S. provisional patent application 62/653,626 filed Apr. 6, 2018, the specification of which is hereby incorporated by reference.

TECHNICAL FIELD

The present invention relates to a dispensing pump.

BACKGROUND

There is a kind of commercially available chemical liquid bottle on which is provided a dispensing pump.

For example, Ding, in U.S. Pat. No. 6,357,629B1, describes a lotion pump, comprises: a nozzle head; a connecting/guiding member connected to the nozzle head, in which an upper one-way valve is disposed; a container cap having a first connection structure and a second connection structure, said first connection structure is to engage with a mouth of a bottle; a housing, on its upper end, there is a connection structure engaging with the second connection structure on the container cap, and on its lower end, there is a lower one-way valve; a piston which moves within the housing, its upper end is connected to the connecting/guiding member; and a spring which makes the piston return; characterized in that, the upper end of the spring abuts against the connecting/guiding member, the lower end of the spring abuts against a spring seat which is provided in the housing. The lotion pump prevents the spring from contacting the lotion, thus it stops the metal spring and the lotion from polluting each other.

However, the pump described by Ding still has more than 10 parts, it complicates the manufacture of the pump and increases its cost.

Another well-known type of pump is described by Andris in U.S. Pat. No. 4,979,646. Andris disclosed: A paste dispenser includes a dispensing pump for dispensing metered amounts of pasty substances, such as toothpaste or the like, from bottle-like or can-like paste containers which have a bellows made of an elastic material. The bellows are arranged between two housing parts which are made of a dimensionally stable material, guided telescopically resiliently one with another, so as to establish communication between the housing parts. One of the housing parts is provided with a tubular discharge orifice which shapes a strand of paste, and communicates with an annular duct formed by two inner and outer sections which are formed on one of the housing parts and are concentric to one another and coaxial to a bellows axis intercommunicating the housing parts. The inner tube section is surrounded by a radially elastic annular wall member or portion of the bellows which forms a valve seat. The annular wall section joins a wall of the bellows in a sealing fashion between the outer and inner sections. The end of the annular wall member rests on the inner surface of the outer tube section. To add colored paste with the sharpest contours possible to the strand of paste, the inner tube section is provided, in order to be used as a reservoir for a color-stripping paste, with one or several striping ducts open directly into said discharge orifice.

The dispenser described by Andris also has multiple small parts, it complicates the manufacture and its assembly.

Various problems also exist, including low restitution rate, design compatibility, metal part corrosion, valve block, leaking (piston leaking, venting leaking). Such problems cause waste of the product and higher cost of the manufacture.

Also new features such as tamper-evidence design, water-resistance ability are quite useful for the pump design.

Therefore, the pump design needed to be improved to solve the existing problems and improve the functions.

SUMMARY

The purpose of the present invention is to provide a dispensing pump mechanism which can improve the functions of the pump, such as one or more of: lower restitution rate, less structural parts, lower cost, water/dust proof, lightweight, easy assembly, etc.

The purpose of the present invention is realized by the following technical solution.

In some embodiments, the dispensing pump has a tamper-evidence structure between a fixed part of said pump and a movable part of said pump, wherein the movement of said movable part breaks said tamper-evidence structure.

In some embodiments, the dispensing pump has off-centered at least one channel in the pump, for example 2 off-centered channels, so that the pump works in multiple open positions by the rotation of the pump.

In some embodiments, the dispensing pump has an air vent on the pump, for example an air vent that is sealed by the rotation of pump.

In some embodiments, the dispensing pump has an inner part and an outer part.

In some embodiments, the dispensing pump is a one-piece over-molded structure having an integrated tamper-evidence linkage between a fixed part of said pump, such as the actuator, and a movable part of said pump, such as the collar.

According to an aspect of the proposed solution, an integrally molded component for a pump comprising: a container collar having an attachment structure for connecting to a container neck; a spout having a dispensing conduit; a tamper-evidence part connected between said collar and said spout, with the spout in upside-down position with respect to said collar; wherein said tamper-evidence part has at least one frangible part and a length extending between said container collar and said spout; said length is just long enough to allow said spout to be positioned immediately above said container collar with a lower end of the spout near the top surface of said container collar and said tamper-evidence part taut, so as to break said at least one frangible part when said spout rotates about an angle on said collar's axis.

According to an aspect of the proposed solution, an integrally molded component for a pump comprising: a container collar having attachment structure; a spout having a dispensing conduit; a tamper-evidence part connected between said collar and said spout, with the spout in upside-down position; when the integrally molded component is installed onto said pump, said tamper-evidence part has a length, which is long enough to allow said spout to be turned 180 degrees and fastened to an actuating part of said pump, the low end of the spout is below the top surface of the container collar; wherein said length of the tamper-evidence part is short enough, so that said tamper-evidence part is broken when said spout is rotated an angle from its initial installation position.

According to a further aspect of the proposed solution, said tamper-evidence part has two frangible points on its two ends, so as to be broken when said spout rotates said angle.

According to a further aspect of the proposed solution, said attachment structure is connecting structures between said collar and said container, such as thread or snap-on design.

According to a further aspect of the proposed solution, said tamper-evidence part has fork shaped linkages, when said spout is turned 180 degrees and fastened to said pump, said fork shaped linkages locate by the two sides of said spout.

According to a further aspect of the proposed solution, a pump for a product container, comprising: an actuating part; and said integrally molded component described above; said tamper-evidence part of said integrally molded component is broken when said spout is rotated an angle from its initial installation position after said pump installed on said product container.

According to another aspect of the proposed solution, a pump for dispensing product from a container comprising: a container collar having at least one off-centre outlet channel, connectable to said container; an actuating part, rotatably mounted on top of said collar; said actuating part has a corresponding passage to said outlet channel, said passage rotating with the rotation of said actuating part follows an arcuate path away from center, wherein the rotation of said actuating part in different positions causes one of said at least one outlet channel to be selectively blocked and in communication with said passage.

According to a further aspect of the proposed solution, two or more outlet channels are set on the collar, the rotation of said actuating part in different positions causes one of the following situations:

all of said outlet channels to be blocked; and all the other of said outlet channels to be blocked except one outlet channel.

According to a further aspect of the proposed solution, said two or more outlet channels are evenly distributed on said collar.

According to a further aspect of the proposed solution, a connecting portion is set around one of said outlet channels for a pipe to suck the product from low part of the container, the other of said outlet channels is configured to accept a product flow in an upside-down position.

According to a further aspect of the proposed solution, said actuating part is above the top opening of the container.

According to another aspect of the proposed solution, a pump for dispensing product from a container comprising: a collar, connectable to an opening of said container; an actuating part, rotatably mounted onto said collar; an air vent, integrated on said collar for reducing the negative pressure in said container; wherein said air vent is switched between blocked and opened when said actuating part is rotated in different positions.

According to a further aspect of the proposed solution, said air vent is blocked by the said actuating part when said actuating part is rotated to a close position.

According to another aspect of the proposed solution, a method for producing a dispensing pump, comprises: molding a first part of said pump with a first material; on said first part, over-molding a second part of said pump with a second material, to form an unfolded one-piece pump structure; said first material is more elastic than said second material; folding said one-piece pump structure at least one time to form said dispensing pump in working state.

According to a further aspect of the proposed solution, said first part of said pump is an elastic actuating part, having an elastic membrane and two valve flaps.

According to a further aspect of the proposed solution, said second part of said pump is a housing of a dispensing chamber and a collar of said pump.

According to a further aspect of the proposed solution, said one-piece pump structure comprises: a dispensing chamber, an actuating part, a tamper-evidence linkage and a collar, said actuating part is connected between said dispensing chamber and said linkage and said linkage links between said actuating part and said collar.

According to a further aspect of the proposed solution, said folding step includes: folding between said dispensing chamber and said actuating part to snap said actuating part onto said dispensing chamber; folding two ends of said tamper-evidence linkage to rotate said collar 180 degrees to connect to said dispensing chamber from its bottom.

According to an aspect of the proposed solution, a one-piece pump comprising: a fixed part; a rotatable part; a tamper-evidence part connected between said fixed part and said rotatable part; wherein said tamper-evidence part is broken when said rotatable part is turned an angle from its initial position.

According to a further aspect of the proposed solution, said rotatable part is an actuator of said pump.

According to a further aspect of the proposed solution, said fixed part is a collar of said pump, which connects to a container, which contains one or more products.

According to a further aspect of the proposed solution, preferably, said rotatable part is above the opening of the container to increase the volume of the products within.

According to another aspect of the proposed solution, a pump for dispensing product from a container comprising: a collar, connectable to an opening of said container; a pumping part, connected onto said collar; wherein at least one outlet channel is off-centre set on the collar and the movement of said pumping part in different positions causes one of said at least one outlet channel to be blocked.

According to a further aspect of the proposed solution, two or more outlet channels are off-centre set on the collar, the movement of said pumping part in different positions causes one of the follow situations: all of said outlet channels to be blocked; and all the other of said outlet channels to be blocked except one outlet channel.

According to a further aspect of the proposed solution, said two or more outlet channels are evenly distributed on said collar.

According to a further aspect of the proposed solution, a connecting portion is set around one of said outlet channels for a pipe to suck the product from low part of the container, the other one of said outlet channels is configured to accept a product flow in a upside-down position.

According to another aspect of the proposed solution, a pump for dispensing product from a container comprising: a collar, connectable to an opening of said container; a pumping part, connected onto said collar; an air vent, integrated on said collar; wherein said air vent reduces the negative pressure in said container.

According to a further aspect of the proposed solution, said air vent is switched between blocked and opened when said pumping part is rotatable in different positions.

According to a further aspect of the proposed solution, said air vent is blocked by the said pumping part when said pumping part is rotated to a close position.

According to another aspect of the proposed solution, a method for producing a dispensing pump, comprises:

over-molding an unfolded one-piece pump structure;

folding said one-piece pump structure at least one time to form said dispensing pump in working state.

The pump in accordance with the proposed solution, such as one-piece or multi-piece pump, can be made by over-molding to reduce the manufacture costs, improve the efficiency and recyclability.

The two-part pump in accordance with the proposed solution can be made by two or more materials, in order to increase the rigidity of the pump's main body while keep the suction and recovering force of the pump.

The pump in accordance with the proposed solution has much less parts, it omits the traditional ball/piston valve and the traditional springs, therefore it reduces the chance of malfunction of the pump, also reduces the chance of contamination by or through the pump, such as the metal spring.

The off-centre design of the pump in accordance with the proposed solution achieves the on/off switch function by rotating the nozzle, further the multiple outlet hole off-centre design of the pump in accordance with the proposed solution achieves the multiple products selecting function.

The pump with the integrated air vents in accordance with the proposed solution reduces the restitution rate, also the air vents can be covered/blocked in the "close" position to reduce the chance of contamination, also increases the water/dust proof ability.

The integrated tamper-evidence design in accordance with the proposed solution ensure the seal and purity of product, in order to protect the user and the reputation of the product brand.

BRIEF DESCRIPTION OF THE DRAWINGS

The invention will be better understood by way of the following detailed description of proposed embodiments with reference to the appended drawings, in which:

FIG. 3A illustrating another embodiment of the proposed solution, is a schematic top view of the structure of a collar for providing air vent integrated on the collar.

FIG. 3B is a schematic sectional A-A view of the structure of the collar of FIG. 3A.

FIG. 3C is a schematic sectional side view of the structure of the collar of FIG. 3A.

FIG. 3D is a schematic detailed sectional view of part B of the structure of the collar of FIG. 3C.

FIG. 3E is a schematic side view of the structure of the collar of FIG. 3A.

FIG. 3F is a schematic bottom view of the structure of the collar of FIG. 3A.

FIG. 3G is a schematic perspective view of the structure of the collar of FIG. 3A.

FIG. 5A illustrating another embodiment of the proposed solution, is a schematic top view of the structure of a pump for providing off-centered 1 channel dispensing, in a close position or seal position.

FIG. 5B is a schematic top view of the structure of the pump of FIG. 5A, in a first open position by rotating the top part by 180 degrees.

FIG. 5C is a schematic sectional side view of the structure of the pump of FIG. 5A.

FIG. 5D is a schematic sectional side view of the structure of the pump of FIG. 5B.

FIG. 5E is a schematic perspective view of the top pump part of FIG. 5A.

FIG. 5F is a schematic perspective view of the low collar part of FIG. 5A.

DETAILED DESCRIPTION

Figures 1A, 1B, 1C:
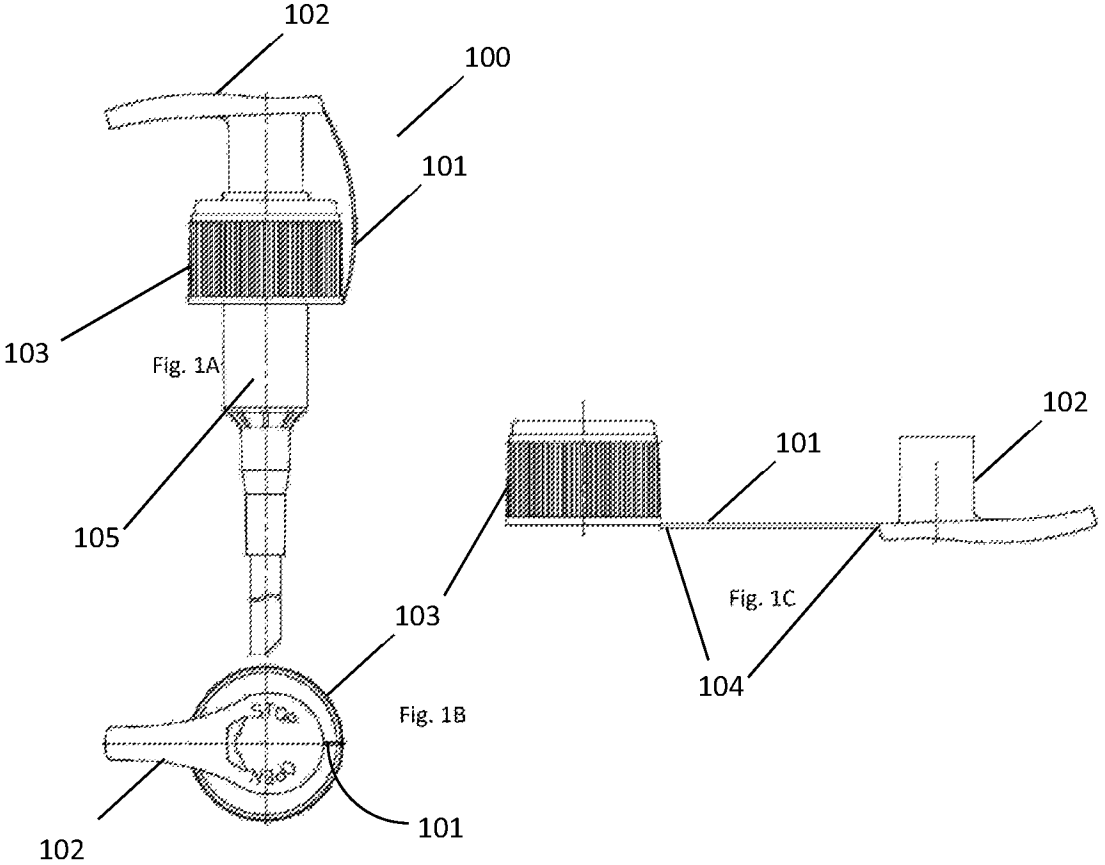
FIG. 1A is a schematic side view of the structure of a pump for providing integrated tamper-evidence design.
FIG. 1B is a schematic top view of the structure of the pump of FIG. 1A.
FIG. 1C is a schematic side view of the structure of the pump of FIG. 1A, in an opened state.

In FIG. 1A-1C, a linkage 101 connected between a spout 102 and a container collar 103 is provided as a tamper-evidence design. Said linkage 101 will be broken when the user turns the spout 102 from a sealed position to a using position.

Before starting to use the product in the sealed container (not shown in the figures), the collar 103 is mounted on the container, and the spout 102 is also screwed in a lower position, a sealed position. The linkage 101 is connected between the spout 102 and the container collar 103, and said connection is in a tight manner so as to the spout 102 cannot turn a significant angle without breaking said linkage 101, such as 45 degrees.

When the user starts to use the product, the spout 102 is turned/unscrewed from said sealed position to a using position, normally turned more than 180 degrees. Therefore the linkage 101 is broken as tamper evidence.

In this embodiment, the integrally molded component for the pump 100 comprising: a container collar 103 having attachment structure to connect to the container, such as thread (e.g. 225 in FIG. 2E) or snap-on design; a spout 102 having a dispensing conduit; a tamper-evidence part (linkage 101) connected between said collar and said spout, with the spout in upside-down position; when the integrally molded component is installed onto said pump, said tamper-evidence part has a length, which is long enough to allow said spout to be turned 180 degrees and fastened to an actuating part of said pump, the low end of the spout is below the top surface of the container collar; wherein said length of the tamper-evidence part is short enough, so that said tamper-evidence part is broken when said spout is rotated an angle from its initial installation position.

The tamper-evidence part has two frangible parts 104 on its two ends.

A pump for a product container, comprising: an actuating part 105 and said integrally molded component 100; said tamper-evidence part of said integrally molded component is broken when said spout is rotated an angle from its initial installation position after said pump installed on said product container.

Figures 2A, 2B, 2C, 2D, 2E, 2F, 2G, 2H, 2I, 2J:
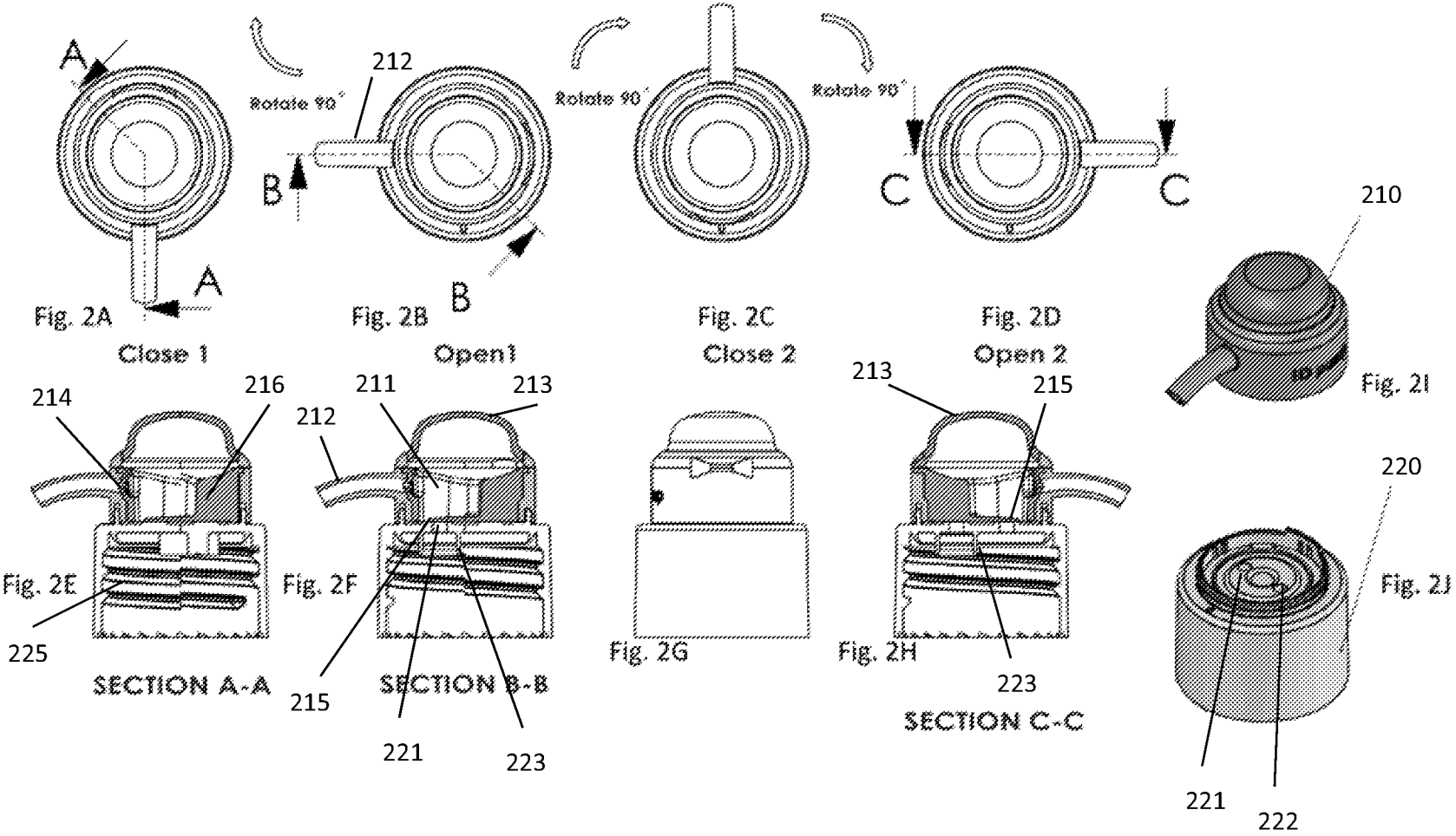
FIG. 2A illustrating another embodiment of the proposed solution, is a schematic top view of the structure of a pump for providing off-centered 2 channels dispensing, in a close position or seal position.
FIG. 2B is a schematic top view of the structure of the pump of FIG. 2A, in a first open position.
FIG. 2C is a schematic top view of the structure of the pump of FIG. 2A, in a close position.
FIG. 2D is a schematic top view of the structure of the pump of FIG. 2A, in a second open position.
FIG. 2E is a schematic A-A sectional view of the structure of the pump of FIG. 2A.
FIG. 2F is a schematic B-B sectional view of the structure of the pump of FIG. 2B.
FIG. 2G is a schematic side view of the structure of the pump of FIG. 2C.
FIG. 2H is a schematic C-C sectional view of the structure of the pump of FIG. 2D.
FIG. 2I is a schematic perspective view of the top pump part of FIG. 2A.
FIG. 2J is a schematic perspective view of the low collar part of FIG. 2A.

In FIG. 2A-2J, there are two off-centered holes 221, 222 set on a top surface of the collar 220. By rotating the pump 210 by every 90 degrees, a dispensing chamber 211 in the pump will be switched between a first close position (FIG. 2A), connecting to a first hole 221 (FIG. 2B), a second closed position (FIG. 2C) and connecting to a second hole 222 (FIG. 2D).

As shown in FIGS. 2A-2J, said pump 210 comprises a nozzle 212 and a dispensing chamber 211. A one-way valve 214 is connected between the nozzle 212 and the dispensing chamber 211 as an outlet. An elastic flap 215 is set on the bottom side of the dispensing chamber 211 as an inlet.

As shown in FIGS. 2B and 2F, the pump 210 is in the open 1 state, wherein the dispensing chamber 211 is connected to the first hole 221, the flap 215 covers the first hole 221 forming an inlet one-way valve. Similar, as shown in FIGS. 2D and 2H, the pump 210 is in the open 2 state, wherein the dispensing chamber 211 is connected to the second hole 222, the flap 215 covers the second hole 222 forming an inlet one-way valve.

The top side of the pump 210 is an elastic membrane 213. The membrane 213 is also the top side of the dispensing chamber 211. The up-down movement of the membrane 213 is actuating force of the pump 210.

The collar 220 is connected, mounted (such as screwed or snapped) onto a container of at least one product (not shown in figures), which contains two kinds of products separately. The two holes 221 and 222 are outlet openings for the two products.

When the pump 210 turns to the open 1 position (as FIGS. 2B, 2F), the membrane 213 is pushed down, the product in the chamber 211 will be dispensed through the nozzle 212; when the pressure on the membrane 213 is removed, the elastic membrane 213 will recover and move back up, the negative pressure is created in the dispensing chamber 211, the valve 214 is shut off and the flap 215 will be pushed up, thus a first product is sucked up through the hole 221, into the chamber 211.

When the pump 210 turns to the open 2 position (as FIGS. 2D, 2H), the membrane 213 is pushed down, the product in the chamber 211 will be dispensed through the nozzle 212; when the pressure on the membrane 213 is removed, the elastic membrane 213 will recover and move back up, the negative pressure is created in the dispensing chamber 211, the valve 214 is shut off and the flap 215 will be pushed up, thus a second product is sucked up through the hole 221, into the chamber 211.

When the pump 210 turns to the close 1 or 2 positions (as FIGS. 2A, 2C, 2E, 2G), the two off-centered holes 221, 222 are both covered and blocked by the wall part 216 of the chamber 211, and the negative pressure in the chamber 211 cannot suck any product up from the container.

In this embodiment, a pump for dispensing product from a container comprising: a container collar 220 having at least one off-centre outlet channel (holes 221 and 222), connectable to said container; an actuating part (pump 210), rotatably mounted on top of said collar; said actuating part has a corresponding passage (chamber 211) to said outlet channel, said passage rotating with the rotation of said actuating part follows an arcuate path away from center, wherein the rotation of said actuating part in different positions causes one of said at least one outlet channel to be selectively blocked and in communication with said passage.

The skilled person in the art can understand, a variation can be made to achieve a single product dispensing by a single off-centered hole on the collar, and a rotation of 180 degrees can switch on and off the pump. Another variation can be made to achieve a three-products dispensing by three off-centered holes on the collar, and a rotation of every 60 degrees can switch on (open 1, open 2, open 3) and off the pump.

Basically, if the container contains multiple (N) kinds of products, and N off-centered holes are set on the collar, a rotation of every 180/N degrees can switch on (open 1, open 2 . . . open N) and off the pump.

In another embodiment of the proposed solution, the collar 220 is connected to a container having one product within. A ring rib 223 is set on the bottom surface of the collar, around one of the holes (221). A pipe can be mounted to the ring rib 223 to extend to the bottom of the container for sucking up the product into the chamber 211.

When the volume of the product in the container is relatively high, such as more than 15%, the dispensing pump should be placed in the open 1 position and the container is in upright position. The product will be sucked up through the pipe and the hole 221, then delivered to the user.

Otherwise when the volume of the product in the container is relatively low, such as less than 15%, the dispensing pump should be placed in the open 2 position and the container is in upside-down position. The product will flow through the hole 222 by gravity, then delivered to the user.

By the upside-down position dispensing, the pump can achieve a lower restitution rate, almost close to 100%.

As shown in FIGS. 2E-2F, the collar 220 can be connected onto a product container (not shown), except a small volume such as the ring rib 223 and sucking pipe, the substantial part (pumping/actuating part) of the pump is above the opening of the container, thus the container volume can be smaller comparing with the one with the traditional pump part installed in the container, so this design can save the container material and costs.

In FIG. 3A-3G, a collar 300 is provided with air vent 304, 305 integrated on top surface of the collar. The collar 300 is similar as the collar 220 in the embodiment of the FIGS. 2A-2J.

The collar 300 has two off-centered holes 301, 302 as the outlet openings of the products from a container/bottle (not shown in figures). The collar 300 is mounted on the container and a pump (e.g. pump 210) is fastened onto the collar 300 by connecting to ribs 303 on the top of the collar.

When the pump (210) is at the open position, the structure of the pump near the two air vent holes 304, 305 causes the chamber of the container connected with the outside air, then reduces the negative pressure inside the container. The detailed structure will be discussed hereafter together with FIG. 7I.

The air vent hole 304 is set correspondingly for the outlet hole 302, when the pump is rotated to the open position for hole 302; similarly, when the pump is rotated to the open position for hole 301, the air vent hole 305 is set correspondingly to connect the container chamber of hole 301.

When the pump is at the close position, the outlet holes 301, 302 are closed, meanwhile the air vent holes 304, 305 are also covered/blocked by the wall (e.g. 216) of the pump.

In FIG. 4A-4K, an improved two-part pump 400 is provided, which comprises an inner part 420 with pump chamber 421 and an outer part 410 with nozzle 412.

The outer part 410 includes a cylinder shape housing 411, a nozzle 412 and a ring shape pressing part 413. The nozzle 412 connects to the housing 411 on one side of the housing 411, the pressing part 413 connects rotatably to the housing 411 on the opposite side.

The inner part 420 includes a chamber part 422 and an elastic membrane 423. The chamber part 422 is cylinder shaped with said off-centered pump chamber 421. On the side of the chamber part 422, near the pump chamber 421, there is a one-way valve 424, which positions corresponding to the nozzle 412, to forming a dispensing outlet together.

Figures 4A, 4B, 4C, 4D, 4E, 4F, 4G, 4H, 4I, 4J, 4K:
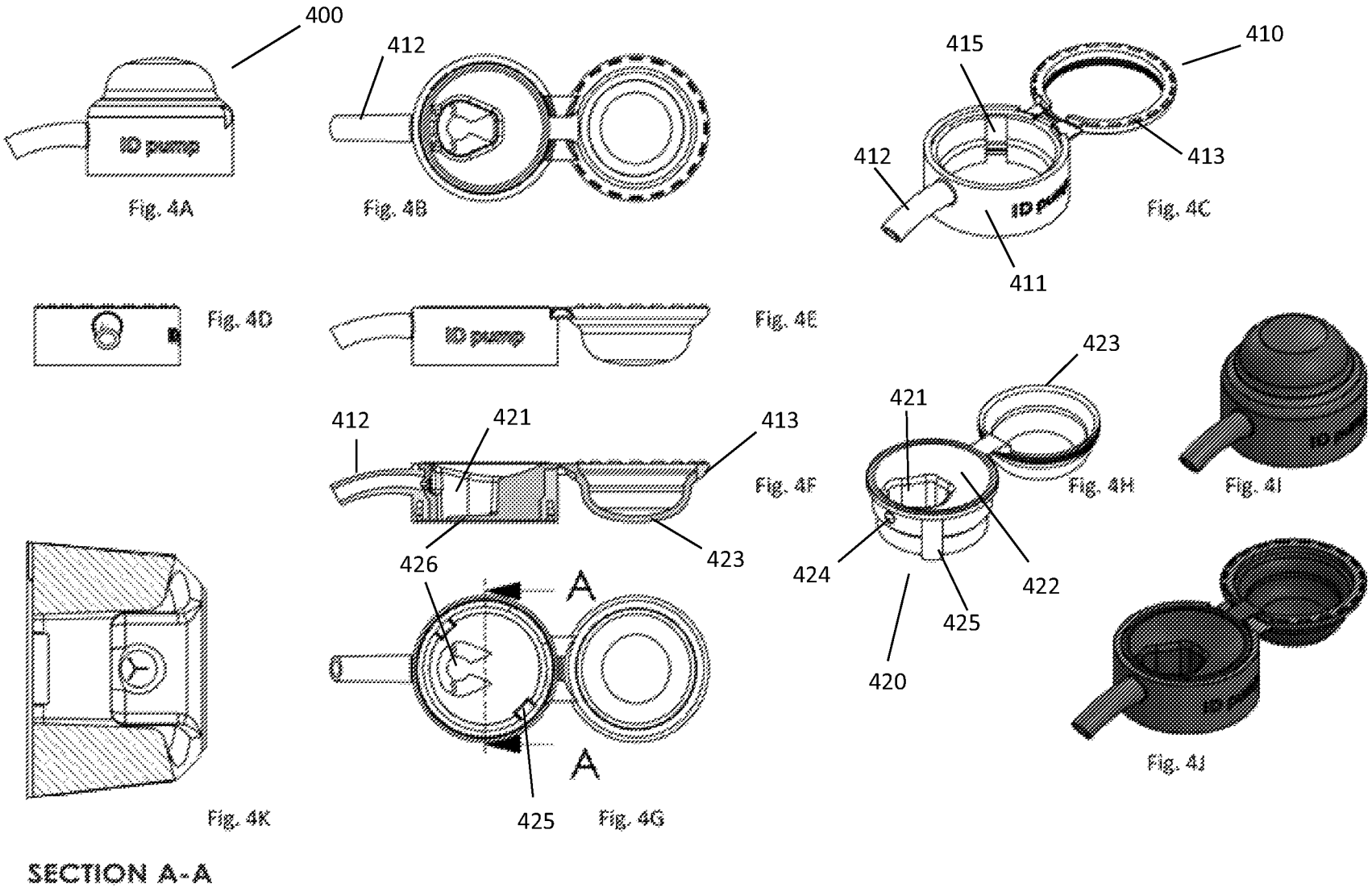
FIG. 4A illustrating another embodiment of the proposed solution, is a schematic side view of the structure of a pump, in which there are one inner part and one out part connected together.
FIG. 4B is a schematic top view of the structure of the two-part pump of FIG. 4A in an opened position.
FIG. 4C is a schematic perspective view of the structure of the out part of the pump of FIG. 4A.
FIG. 4D is a schematic left side view of the structure of the two-part pump of FIG. 4B.
FIG. 4E is a schematic front side view of the structure of the two-part pump of FIG. 4B.
FIG. 4F is a schematic front sectional view of the structure of the two-part pump of FIG. 4B.
FIG. 4G is a schematic bottom view of the structure of the two-part pump of FIG. 4B.
FIG. 4H is a schematic perspective view of the structure of the inner part of the pump of FIG. 4A.
FIG. 4I is a schematic perspective view of the structure of the two-part pump of FIG. 4A.
FIG. 4J is a schematic perspective view of the structure of the two-part pump of FIG. 4B.
FIG. 4K is a schematic sectional A-A view of the structure of the two-part pump of FIG. 4G.

There are ribs 425 and corresponding grooves 415 set, respectively on the out surface of the chamber part 422 and the inner surface of the housing 411, so as to fasten the chamber part 422 into the housing 411, as shown in FIGS. 4F and 4G.

The membrane 423 is bowl shaped, its structure and movement are similar as membrane 213. An elastic flap 426 is set on the bottom side of the pump chamber 421 as an inlet.

As shown in FIG. 4E-4F, the inner part 420 is installed/fastened into the outer part 410, the one-way valve 424 is aligned with the nozzle 412, the pressing part 413 covers the edge of the membrane 423.

When the pressing part 413 rotates 180 degrees with the membrane 423, the pressing part 413 is fastened to the upper edge of the outer part 410, while the membrane 423 is pressed onto the chamber part 422 to form an air-tight pump chamber 421 for dispensing the product.

The inner part 420 and the outer part 410 can be made of same or different materials, preferably the material for the inner part 420 is more elastic than that of the outer part 410.

In FIG. 5A-5F, an off-centered single channel dispensing pump 500 is provided. By rotating the pump part 510 by 180 degrees, the pump 500 can be switched On/Off.

Said pump part 510 comprises a nozzle 512 and a dispensing chamber 511. A one-way valve 514 is connected between the nozzle 512 and the dispensing chamber 511 as an outlet. An elastic flap 515 is set on the bottom side of the dispensing chamber 511 as an inlet.

A collar 520 is connected between a product container (not shown) and said pump part 510. An opening hole 521 is set on the top surface of the collar 520.

As shown in FIGS. 5B and 5D, the pump 510 is in the open state, wherein the dispensing chamber 511 is connected to the hole 521, the flap 515 covers the hole 521 forming an inlet one-way valve.

The top side of the pump 510 is an elastic membrane 513. The membrane 513 is also the top side of the dispensing chamber 511. The up-down movement of the membrane 513 is actuating force of the pump 510.

When the pump 510 turns to the open position (as FIGS. 5B, 5D), the membrane 513 is pushed down, the product in the chamber 511 will be dispensed through the nozzle 512; when the pressure on the membrane 513 is removed, the elastic membrane 513 will recover and move back up, the negative pressure is created in the dispensing chamber 511, the valve 514 is shut off and the flap 515 will be pushed up, thus the product in the container is sucked up through the hole 521, into the chamber 511.

When the pump part 510 turns to the close position (as FIGS. 5A, 5C), the off-centered hole 521 is covered and blocked by the wall part 516 of the chamber 511, and the negative pressure in the chamber 511 cannot suck the product up from the container.

In FIG. 6A-6E, an off-centered 1 channel collar 520 is shown for working with the pump 510 of FIG. 5A-5F.

The collar 520 is mounted on the container and said pump 510 is fastened onto the collar 520 by connecting to ribs 522 on the top of the collar.

Figure 6D:
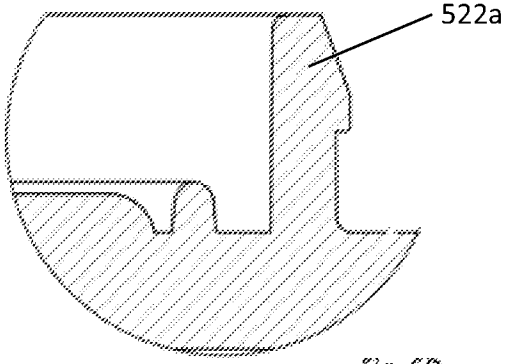
FIG. 6D is a schematic detailed sectional view of part A of the structure of the collar of FIG. 6C.
Figure 6E:
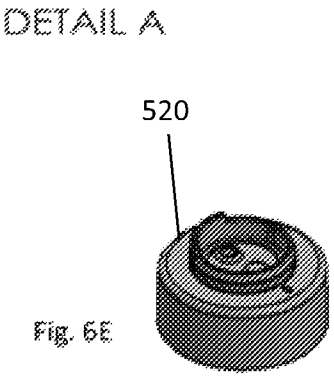
FIG. 6E is a schematic perspective view of the collar of FIG. 6A.
Figure 6C:
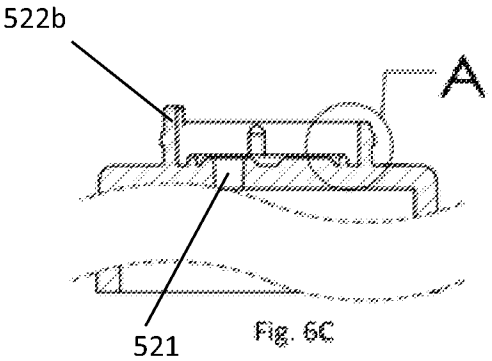
FIG. 6C is a schematic sectional side view of the structure of the collar of FIG. 6A.
Figure 6A:
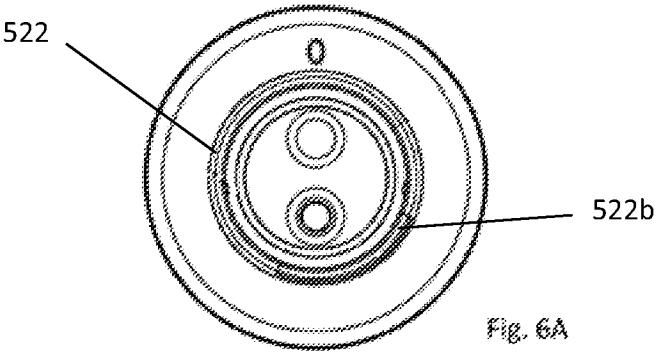
FIG. 6A illustrating another embodiment of the proposed solution, is a schematic top view of the structure of a collar for providing off-centered 1 channel dispensing.
Figure 6B:
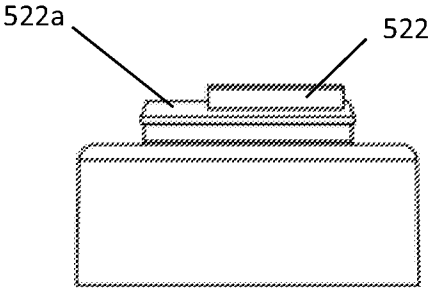
FIG. 6B is a schematic side view of the structure of the collar of FIG. 6A.

A part of the ribs 522*b* is taller than the rest 522*a*, as shown in FIGS. 6B-6C, and corresponding grooves 517 in the pump part 510 have constant depth. The gap between the lower ribs 522*a* and the grooves 517 forms air vent to reduce the negative pressure inside the container.

Figures 7A, 7B, 7C, 7D, 7E, 7F, 7G, 7H, 7I, 7J:
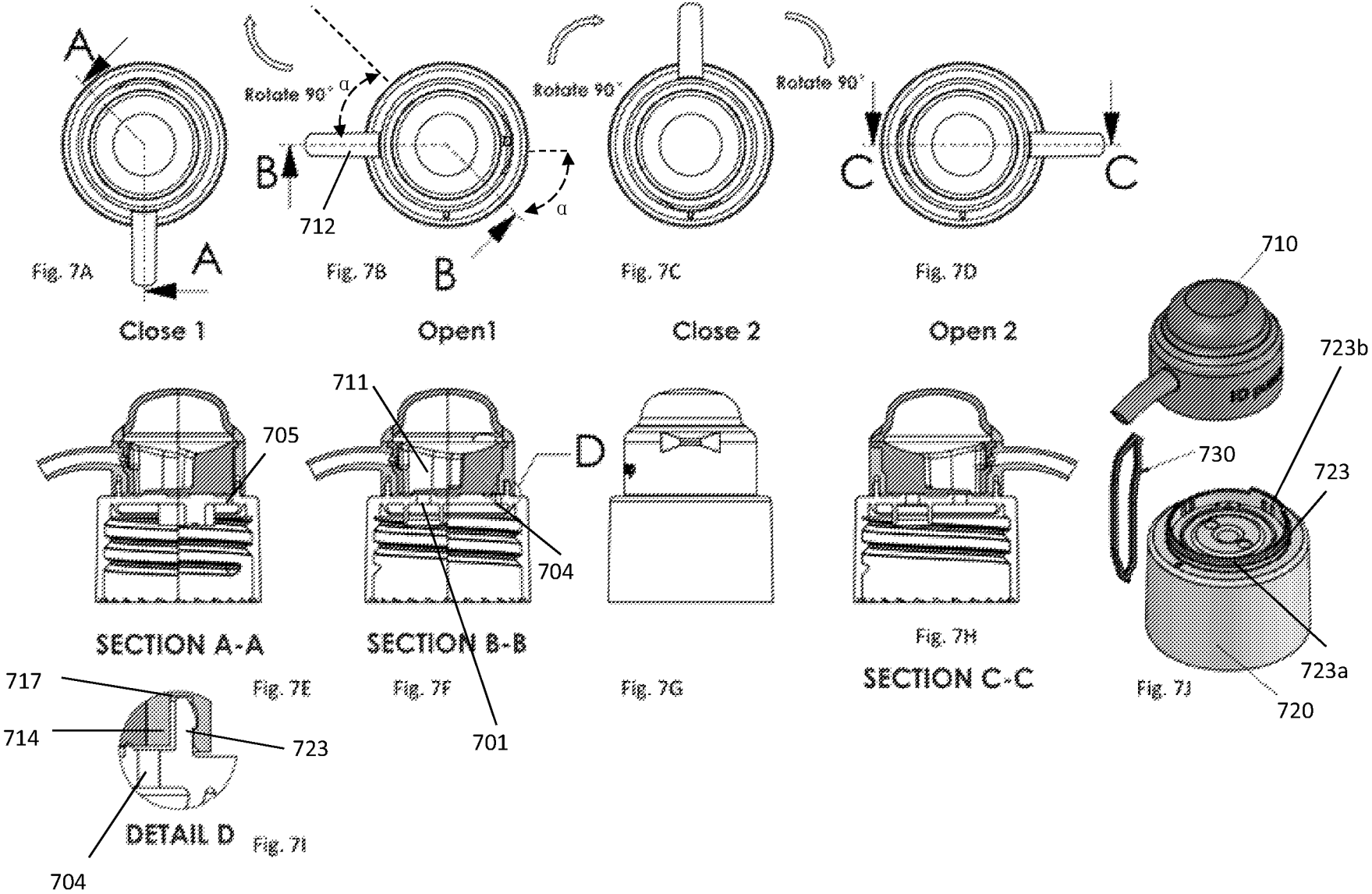
FIG. 7A illustrating another embodiment of the proposed solution, is a schematic top view of the structure of a pump for providing off-centered 2 channels dispensing, in a close position or seal position, wherein air vent is integrated on the collar.
FIG. 7B is a schematic top view of the structure of the pump of FIG. 7A, in a first open position.
FIG. 7C is a schematic top view of the structure of the pump of FIG. 7A, in a close position.
FIG. 7D is a schematic top view of the structure of the pump of FIG. 7A, in a second open position.
FIG. 7E is a schematic A-A sectional view of the structure of the pump of FIG. 7A.
FIG. 7F is a schematic B-B sectional view of the structure of the pump of FIG. 7B.
FIG. 7G is a schematic side view of the structure of the pump of FIG. 7C.
FIG. 7H is a schematic C-C sectional view of the structure of the pump of FIG. 7D.
FIG. 7I is a schematic detailed sectional view of part D of the structure of the pump of FIG. 7F, showing the details of air vent on the collar.
FIG. 7J is a schematic perspective view of the lower and top part of the pump of FIG. 7A, wherein a linkage connected between the top part and the lower part of the pump is provided as a removable tamper-evidence design.

In FIG. 7A-7J, there are two holes on a top surface of the collar 720. By rotating the pump part 710 by every 90 degrees, a dispensing chamber in the pump part will be switched between a first closed position, connecting to a first hole, a second closed position and connecting to a second hole. In FIG. 7J, a linkage 730 is connected between the top part and the lower part of the pump is provided as a removable tamper-evidence design.

This embodiment in FIG. 7A-7J is a variation structure of the pump as shown in FIGS. 2A-2J. The pump 710 is similar as the pump 210 and the collar 720 is similar as the collar 300 shown in FIGS. 3A-3G.

The pump part 710 is fastened onto the collar 720 by connecting to ribs 723 on the top of the collar.

Parts of the ribs 723*b* are taller than the rest 723*a*, as shown in FIG. 7J, and corresponding grooves 717 in the pump part 710 have constant depth. The gap between the lower ribs 723*a* and the grooves 717 forms air vent path to reduce the negative pressure inside the container.

In this embodiment, a pump for dispensing product from a container comprising: a collar 720, connectable to an opening of said container; an actuating part (pump 710), rotatably mounted onto said collar; an air vent 704, integrated on said collar for reducing the negative pressure in said container; wherein said air vent is switched between blocked and opened when said actuating part (pump 710) is rotated in different positions.

Said actuating part (pump 710) is turned 180 degrees and fastened to said collar, said tamper-evidence part 730 has fork shaped linkages, said fork shaped linkages locate by the two sides of said nozzle 712.

The detailed structure of the air vent in this embodiment is discussed with FIGS. 3A-3D and FIGS. 7E-7F, 7I-7J.

As shown in FIGS. 3A, 7B, 7F, 7I, the pump 710 turns to the open 1 position, the dispensing chamber 711 is connected to an opening hole 701 (as 301) of the collar for accessing the first product; at this open 1 position, a higher corner part 714 of the pump 710 above the air vent hole 704 (as 304) leaves a gap in-between, forming an air vent path.

When the pump 710 turns to the close 1 position as shown in FIGS. 7A, 7E, a lower corner part of the pump 710 covers and blocks the air vent hole 705 (as 305), thus to seal the product container to reduce the chance of contamination.

Preferably, as shown in FIG. 3A, the angle between the line of the air vent holes 304, 305 and the line of the outlet holes 301, 302 is a, therefore the higher corner part 714 is located with an angle of $\alpha$ or/and $\alpha$+180 degrees to the nozzle 712 (in FIG. 7B). Preferably, a is 45 degrees.

In FIG. 7J, the linkage 730 is provided as a removable tamper-evidence design when the pump 710 is in the close 1 position. Said linkage 730 will be broken when the user turns the pump 710 to any open (1 or 2) position.

Figures 8A, 8B, 8C:
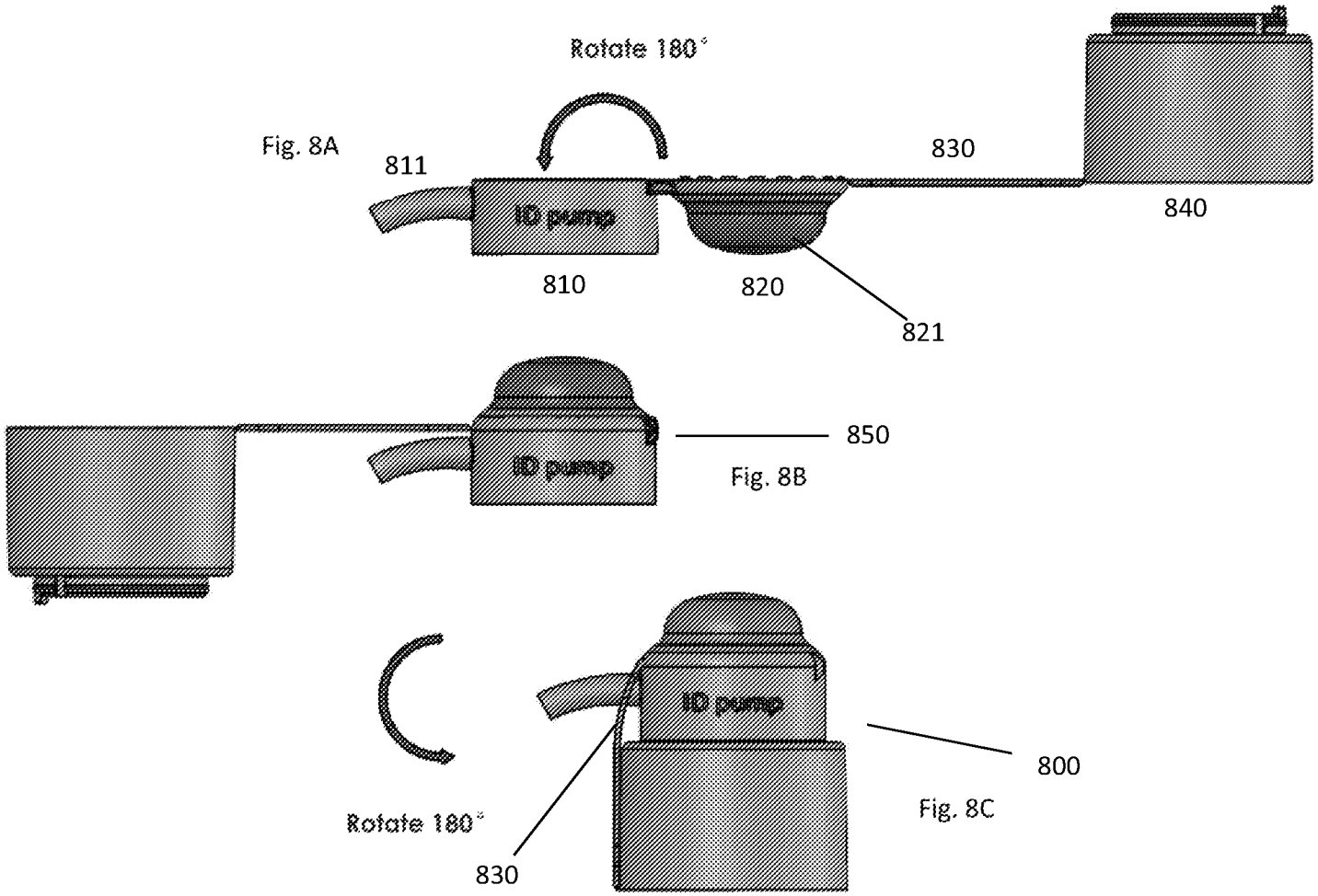
FIG. 8A illustrating another embodiment of the proposed solution, is a schematic side view of the structure of a one-piece pump having integrated tamper-evidence design.
FIG. 8B is a schematic side view of the structure of the pump of FIG. 8A, wherein the dispensing chamber and the pump cap are assembled.
FIG. 8C is a schematic side view of the structure of the pump of FIG. 8A, wherein the pump is assembled, ready to set on a bottle container, with the integrated tamper-evidence design in a sealed position.

FIG. 8A-8C show the assembling steps of a one-piece pump 800, which has integrated tamper-evidence design.

The one-piece pump 800 comprises: a pump housing 810 having a nozzle 811 on its side, a pump pressing part 820 having an elastic membrane 821, a linkage 830 and a collar 840.

The pump pressing part 820 is connected to the pump housing 810 on the opposite side to said nozzle 811. The pump pressing part 820 is rotatably to be fastened onto the pump housing 810 to form a pump part 850 having an air-tight dispensing chamber within (similar as FIGS. 4A-4B), which is shown in FIG. 8B.

In FIG. 8B, the linkage 830 is connected between the bottom side of the collar 840 and the top side of the pump part 850, then rotate the collar 840 to the bottom of the pump part 850 and fasten them together, preferably by connecting ribs on the collar to grooves of the pump housing 810, as shown in FIG. 8C. The pump 800 in FIG. 8C can be fastened onto a container (not shown), such as by screw connection. The pump 800 in FIG. 8C is in a sealed/close position, and said linkage 830 will be broken when the user turns the pump 800 to any open position.

FIG. 9A-9L show a one-piece over-molded pump, which has integrated tamper-evidence design, wherein the pump part comprises an inner part 910 with pump chamber and an outer part 920.

Figures 9A, 9B, 9C, 9D, 9E, 9F, 9G, 9H, 9I, 9J, 9K, 9L:
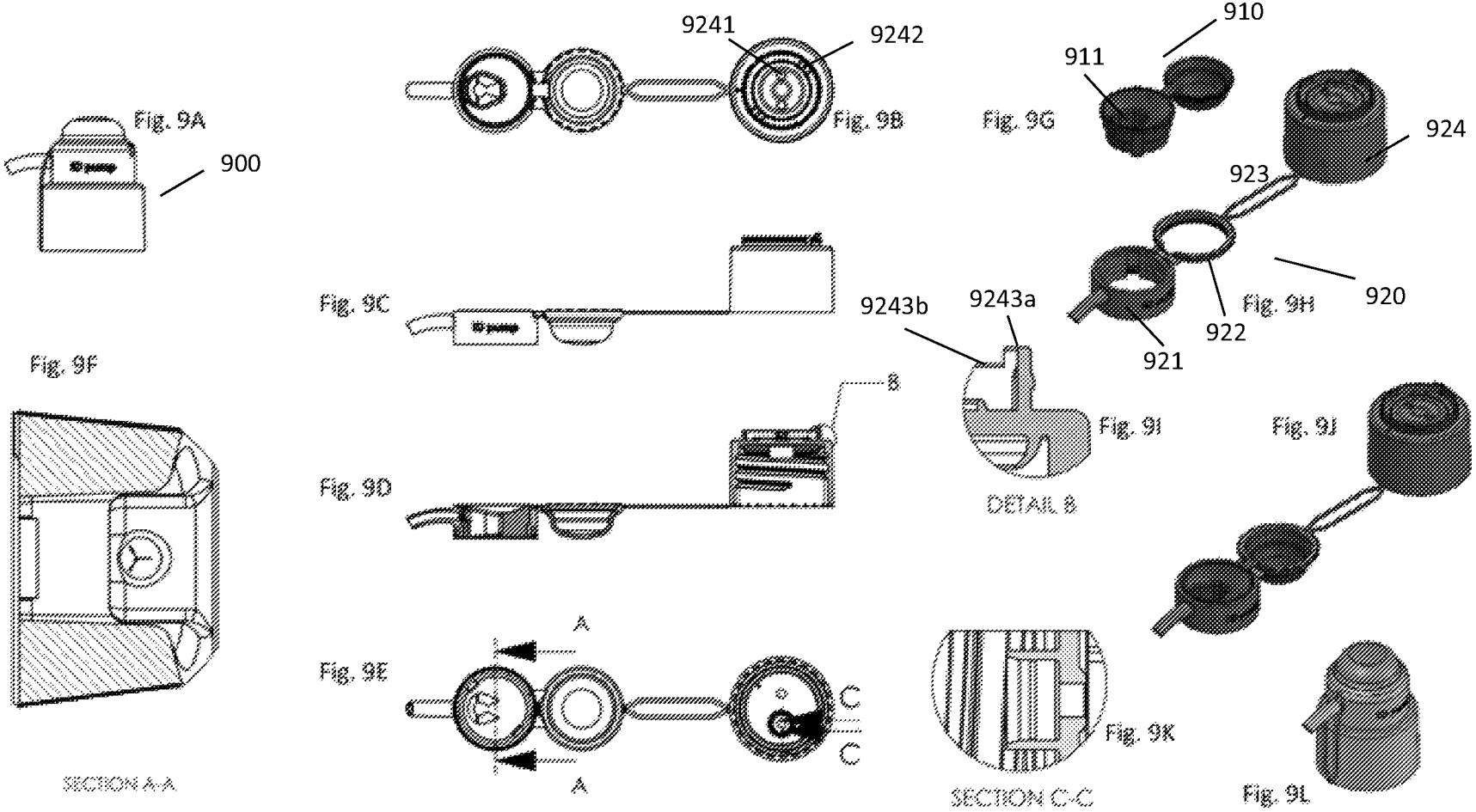
FIG. 9A illustrating another embodiment of the proposed solution, is a schematic side view of the structure of a one-piece pump having integrated tamper-evidence design, in which the pump comprises one inner part and one out part over molded together.
FIG. 9B is a schematic top view of the structure of the one-piece pump of FIG. 9A in an opened position.
FIG. 9C is a schematic front side view of the structure of the one-piece pump of FIG. 9B.
FIG. 9D is a schematic front sectional view of the structure of the one-piece pump of FIG. 9B.
FIG. 9E is a schematic bottom view of the structure of the one-piece pump of FIG. 9B.
FIG. 9F is a schematic sectional A-A view of the structure of the one-piece pump of FIG. 9E.
FIG. 9G is a schematic perspective view of the structure of the inner part of the pump of FIG. 9A.
FIG. 9H is a schematic perspective view of the structure of the out part of the pump of FIG. 9A.
FIG. 9I is a schematic detailed sectional view of part B of the structure of the pump of FIG. 9D.
FIG. 9J is a schematic perspective view of the structure of the one-piece pump of FIG. 9B.
FIG. 9K is a schematic sectional C-C view of the structure of the one-piece pump of FIG. 9E.
FIG. 9L is a schematic perspective view of the structure of the one-piece pump of FIG. 9A.

In this embodiment, a method for producing a dispensing pump 900, comprises: molding a first part (910) of said pump with a first material; on said first part, over-molding a second part (920) of said pump with a second material, to form an unfolded one-piece pump structure as FIG. 9J; said first material is more elastic than said second material; folding said one-piece pump structure at least one time to form said dispensing pump in working status, as shown in FIGS. 8A-8C.

The inner part 910 and the outer part 920 can be made of same or different materials, preferably the material for the inner part 910 is more elastic than that of the outer part 920.

The outer part 920 includes a cylinder shape housing 921 with a nozzle, a ring shape pressing part 922, a linkage 923 as the tamper-evidence, and a collar 924.

The structure of the inner part 910 is similar as the inner part 420 in FIG. 4H and the cylinder shape housing 921 and the ring shape pressing part 922 are similar to the parts 411, 413 in FIG. 4C.

Preferably, in FIG. 9B, the collar has off-centered 2 dispensing channels 9241. Preferably, the collar has air vent holes 9242 set on a surface of the collar in FIG. 9B.

Preferably, said air vent holes 9242 can be blocked by the rotation of the pump chamber, such as described above and in FIG. 7E-7F, in particular, the lower corner of pump chamber 911 can block the air vent holes 9242.

The inner part 910 is set in the outer part 920, forming the pump 900 as shown in FIGS. 9B and 9J. The pump 900 of FIG. 9J can be folded as the steps of FIGS. 8A-8C, becoming the pump ready to use in FIG. 9L.

As shown in FIG. 9I, the ribs 9243*a* and 9243*b* is set to connect the collar 924 and the cylinder shape housing 921. Parts of the ribs 9243*a* are taller than the rest 9243*b*, as shown in FIG. 9I, and corresponding grooves in the cylinder shape housing 921 have constant depth. The gap between the lower ribs and the grooves forms air vent path to reduce the negative pressure inside the container.

In FIG. 10A-10K, similar as the pump in FIG. 4A-4J, another design of an improved two-part pump is provided, which comprises an inner part 1020 with pump chamber 1021 and an out part 1010 with nozzle 1012.

The outer part 1010 includes a cylinder shape housing 1011, a nozzle 1012 and a ring shape pressing part 1013. The nozzle 1012 connects to the housing 1011 on one side of the housing 1011, the pressing part 1013 connects rotatably to the housing 1011 on the opposite side.

The inner part 1020 includes a chamber part 1022 and an elastic membrane 1023. The chamber part 1022 is cylinder shaped with said off-centered pump chamber 1021. On the side of the chamber part 1022, near the pump chamber 1021, there is a one-way valve 1024, which positions corresponding to the nozzle 1012, to forming a dispensing outlet together.

Figures 10A, 10B, 10C, 10D, 10E, 10F, 10G, 10H, 10I, 10J, 10K:
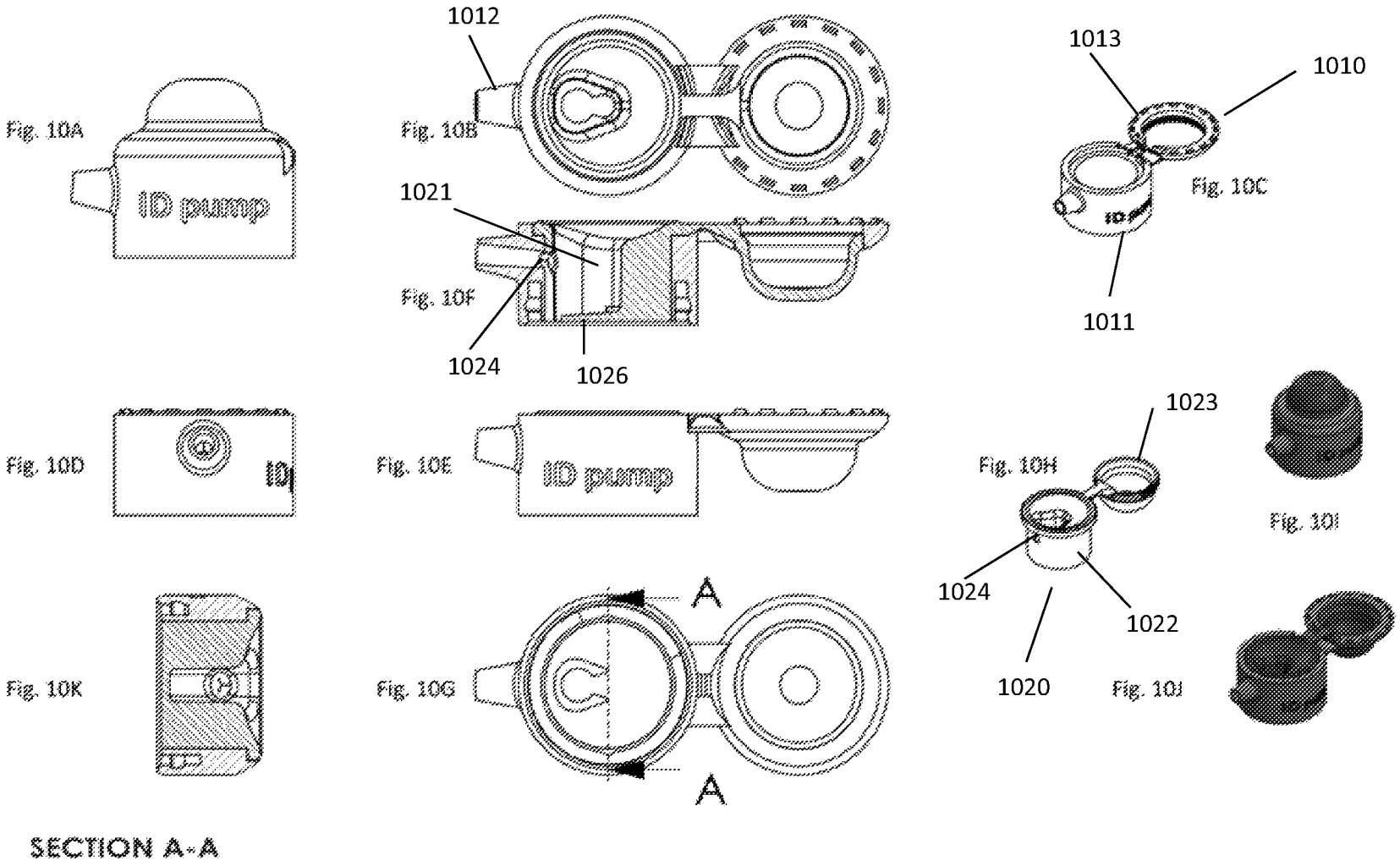
FIG. 10A illustrating another embodiment of the proposed solution, is a schematic side view of the structure of a pump, in which there are one inner part and one out part over molded together.
FIG. 10B is a schematic top view of the structure of the two-part pump of FIG. 10A in an opened position.
FIG. 10C is a schematic perspective view of the structure of the out part of the pump of FIG. 10A.
FIG. 10D is a schematic left side view of the structure of the two-part pump of FIG. 10B.
FIG. 10E is a schematic front side view of the structure of the two-part pump of FIG. 10B.
FIG. 10F is a schematic front sectional view of the structure of the two-part pump of FIG. 10B.
FIG. 10G is a schematic bottom view of the structure of the two-part pump of FIG. 10B.
FIG. 10H is a schematic perspective view of the structure of the inner part of the pump of FIG. 10A.
FIG. 10I is a schematic perspective view of the structure of the two-part pump of FIG. 10A.
FIG. 10J is a schematic perspective view of the structure of the two-part pump of FIG. 10B.
FIG. 10K is a schematic sectional A-A view of the structure of the two-part pump of FIG. 10G.

The chamber part 1022 can fasten in the housing 1011, as shown in FIG. 10F.

The membrane 1023 is bowl shaped, its structure and movement are similar as membrane 213. An elastic flap 1026 is set on the bottom side of the pump chamber 1021 as an inlet.

As shown in FIG. 10F, the inner part 1020 is installed/fastened in the outer part 1010, the one-way valve 1024 is aligned with the nozzle 1012, the pressing part 1013 covers the edge of the membrane 1023.

When the pressing part 1013 rotates 180 degrees with the membrane 1023, the pressing part 1013 is fastened to the upper edge of the outer part 1010, while the membrane 1023 is pressed onto the chamber part 1022.

The inner part 1020 and the outer part 1010 can be made of same or different materials, preferably the material for the inner part 1020 is more elastic than that of the outer part 1010.

By comparing the pump 100 and the pumps 800, 900, the core of the pump is moved out of the container, it increase the volume of the product of a same container, correspondingly the standard volume product requires a smaller container, thus it saves the material and reduces the cost of packaging.

While the invention has been shown and described with reference to preferred embodiments thereof, it will be recognized by those skilled in the art that various changes in form and detail may be made therein without departing from the spirit and scope of the invention as defined by the appended claims.

The invention claimed is:

1. A pump for dispensing product from a container comprising:

a container collar having at least one off-centre outlet channel connectable to said container;

an actuating part, rotatably mounted on top of said collar;

said actuating part has a corresponding passage to said outlet channel, said passage rotating with the rotation of said actuating part follows an arcuate path away from center, wherein the rotation of said actuating part in different positions (A, B, C) causes one of said at least one outlet channel to be selectively blocked (A) and in communication with said passage (B, C), wherein two or more outlet channels are set on the collar, the rotation of said actuating part in different positions causes one of the following situations:

all of said outlet channels to be blocked; and all the other of said outlet channels to be blocked except one outlet channel, wherein a connecting portion is set around one of said outlet channels for a pipe to suck the product from low part of the container, the other of said outlet channels is configured to accept a product flow in an upside-down position.

2. The pump claimed in claim 1, wherein said two or more outlet channels are evenly distributed on said collar.

3. The pump claimed in claim 1, said actuating part is above the top opening of the container.

4. A pump for dispensing product from a container comprising:

a container collar having at least one off-centre outlet channel connectable to said container and at least one air vent integrated on said collar; and an actuating part, rotatably mounted on top of said collar, said actuating part having a spout and a corresponding passage to said outlet channel, said actuating part being configured to draw liquid from said outlet channel and expel said liquid through said spout, said passage rotating with the rotation of said actuating part follows an arcuate path away from center, wherein the rotation of said actuating part in different positions (A, B, C) causes one of said at least one outlet channel to be selectively blocked (A) and in communication with said passage (B, C), and wherein said at least one air vent reduces the negative pressure in said container said at least one air vent being switched between blocked (A-A) and opened (B-B) when said actuating part is rotated in different positions.

5. The pump claimed in claim 4, wherein said at least one air vent is blocked by the said actuating part when said actuating part is rotated to a close position (A-A).

6. A pump for dispensing product from a container comprising:

a container collar having at least one off-centre outlet channel connectable to said container; and an actuating part, rotatably mounted on top of said collar, said actuating part having a spout and a corresponding passage to said outlet channel, said actuating part being configured to draw liquid from said outlet channel and expel said liquid through said spout, said passage rotating with the rotation of said actuating part follows an arcuate path away from center, wherein the rotation of said actuating part in different positions (A, B, C) causes one of said at least one outlet channel to be selectively blocked (A) and in communication with said passage (B, C), and wherein said actuating part comprises an actuator integrally molded with a first part and a second part, such that:

said first part of said actuator is molded with a first material;

said second part of said actuator is molded over said first part of said actuator with a second material, said first material being more elastic than said second material, and wherein the integrally molded actuator is folded at least one time to form a working state actuator.

7. The pump claimed in claim 6, wherein said first part of said integrally molded actuator is an elastic actuating part having an elastic membrane and at least one valve flap.

8. The pump claimed in claim 6, wherein said second part of said integrally molded actuator is a housing of a dispensing chamber and a collar of said pump.

9. The pump claimed in claim 6, wherein said integrally molded actuator comprises a dispensing chamber, an actuating part, a tamper-evidence linkage and a collar;

said actuating part is connected between said dispensing chamber and said linkage;

said linkage links between said actuating part and said collar.

10. The pump claimed in claim 6, wherein said integrally molded actuator is folded at least one time between said dispensing chamber and said actuating part to snap said actuating part onto said dispensing chamber;

wherein two ends of said tamper-evidence linkage are folded to rotate said collar 180 degrees to connect to said dispensing chamber from its bottom.

* * * * *